US005503611A

United States Patent [19]

Richter et al.

[11] Patent Number: 5,503,611

[45] Date of Patent: Apr. 2, 1996

[54] METHOD FOR THE MANUFACTURE OF PADDED MAILING CONTAINERS, AND APPARATUS THEREFOR

[75] Inventors: Karl-Heinz Richter, Crailsheim; Georg Kucha, Feuchtwangen, both of Germany

[73] Assignee: Vereinigte Papierwarenfabriken GmbH, Munich, Germany

[21] Appl. No.: 173,221

[22] Filed: Dec. 27, 1993

[30] Foreign Application Priority Data

Dec. 28, 1992 [DE] Germany ..... 42 44 363.6

[51] Int. Cl.[6] ..... B31B 39/74; B31B 39/60

[52] U.S. Cl. ..... 493/220; 493/224; 493/264; 493/333; 493/334; 493/335; 156/269; 156/291; 156/311; 156/320; 156/324; 156/522

[58] Field of Search ..... 493/190, 191, 493/214, 220, 223, 240, 241, 222, 224, 228, 242, 264, 265, 266, 332, 333, 334, 335; 156/176, 177, 221, 269, 271, 291, 311, 320, 324, 522

[56] References Cited

U.S. PATENT DOCUMENTS

| | | | |
|---|---|---|---|
| 3,672,949 | 6/1972 | Brown | 156/291 |
| 3,867,874 | 2/1975 | O'Neil | 493/264 |
| 4,011,798 | 3/1977 | Bambara et al. . | |
| 4,253,892 | 3/1981 | D'Angelo et al. | 156/84 |
| 4,826,475 | 5/1989 | Eweryd | 493/10 |
| 5,021,039 | 6/1991 | Richter et al. | 493/190 |

FOREIGN PATENT DOCUMENTS

| | | | |
|---|---|---|---|
| 0441465 | 8/1991 | European Pat. Off. . | |
| 1675907 | 2/1954 | Germany . | |
| 1807471 | 12/1959 | Germany . | |
| 1894663 | 1/1964 | Germany . | |
| 2437968 | 2/1976 | Germany . | |
| 2824049 | 12/1979 | Germany . | |
| 8606771 | 7/1986 | Germany . | |
| 3612136C2 | 10/1987 | Germany . | |
| 3612136A1 | 10/1987 | Germany . | |
| 3739641 | 6/1989 | Germany . | |
| 1238084 | 7/1971 | United Kingdom . | |
| 1558386 | 12/1979 | United Kingdom | 156/291 |

*Primary Examiner*—Jack W. Lavinder
*Attorney, Agent, or Firm*—Lowe, Price, LeBlanc & Becker

[57] ABSTRACT

A mailing container having upper and lower plain paper layers padded with at least two layers of globular paper is made with feed and unwinding devices for upper and lower paper webs and an unwinding device for the padded webs. A device connects the paper webs with padded webs adjacent an edge of the mailing containers. A device cuts the mailing containers to a predetermined format. A station for globular paper includes at least one supply roll to be unwound from the upper paper web and a lower paper web. A reactivatable hot melt adhesive is applied along predetermined zones, on at least one of the globular paper webs and on at least one web of the upper and lower paper webs before the webs are brought together. The hot melt adhesive applied to the predetermined zones between the upper and lower paper web and/or between the globular paper webs causes these webs to be permanently joined.

33 Claims, 5 Drawing Sheets

METHOD FOR THE MANUFACTURE OF PADDED MAILING CONTAINERS, AND APPARATUS THEREFOR

FIELD OF THE INVENTION

The invention relates to a method and apparatus for manufacturing padded mailing containers.

BACKGROUND OF THE RELATED ART

A method and an apparatus of this type are known, see the German patent publication DE 36 12 136 A1. Envelopes constituting one form of such mailing containers have padding films with included air and in the course of production such envelopes are permanently connected to a supplied paper web by connection means, more particularly sealing means.

SUMMARY OF THE INVENTION

One object of the present invention is to provide a method as well as an apparatus for the production of mailing containers, and such a container itself, which substantially or completely consist of recyclable material.

The invention renders possible the manufacture of padded envelopes which comprise an upper and a lower paper web and at least two further paper webs arranged between the upper and lower paper webs, said further paper webs preferably being in the form of globular paper and producing a padding effect. The term globular paper means a paper which has been processed by an embossing device or the like from an initial essentially plane form to one in which there are pluralities of raised and/or depressed portions which are inherently deformable and which help to protect the contents of the mailing container in use.

The envelopes in accordance with the invention consist exclusively of paper with the exception of a protective strip for a self seal closure in the case of self seal envelopes, such protective strip being removed prior to use for the purpose of sticking down the flap of the envelope. Such an envelope is able to be fully recycled after use. It has been found that the hot melt adhesive can be drawn or skimmed off, when the paper is pulped down, from a digested waste paper suspension so that such adhesive does not find its way into the water circuit during reworking the paper. The hot melt adhesive therefore becomes detached in the course of the recycling process and unlike dispersion adhesives or the like can be skimmed from the surface.

In accordance with the invention in the method employed or in the apparatus utilized, the supply of the upper and lower paper webs on the one hand and the supply of the upper and lower globular paper webs on the other hand is so controlled to be dependent on certain markings printed on (for example) the top paper web that the respectively necessary applications of hot melt adhesive are so made that an in-register association of the applied patches of hot melt adhesive between the outer paper web on the one hand and the inner paper preferably constituted by globular paper on the other hand is possible prior to bringing the four paper webs together.

In accordance with a preferred working embodiment of the device in accordance with the invention there is a provision in accordance with which for the paper webs constituting the padding layers or plies plain paper is employed, which is so embossed within the apparatus by embossing rolls that (for instance) globular paper is produced, which has a predetermined padding effect.

BRIEF DESCRIPTION OF THE DRAWINGS

Preferred embodiments of the invention will now be described with reference to the drawing for the explanation of further advantages and features thereof.

DETAILED DESCRIPTION OF THE PREFERRED EMBODIMENTS

Figure 1A:
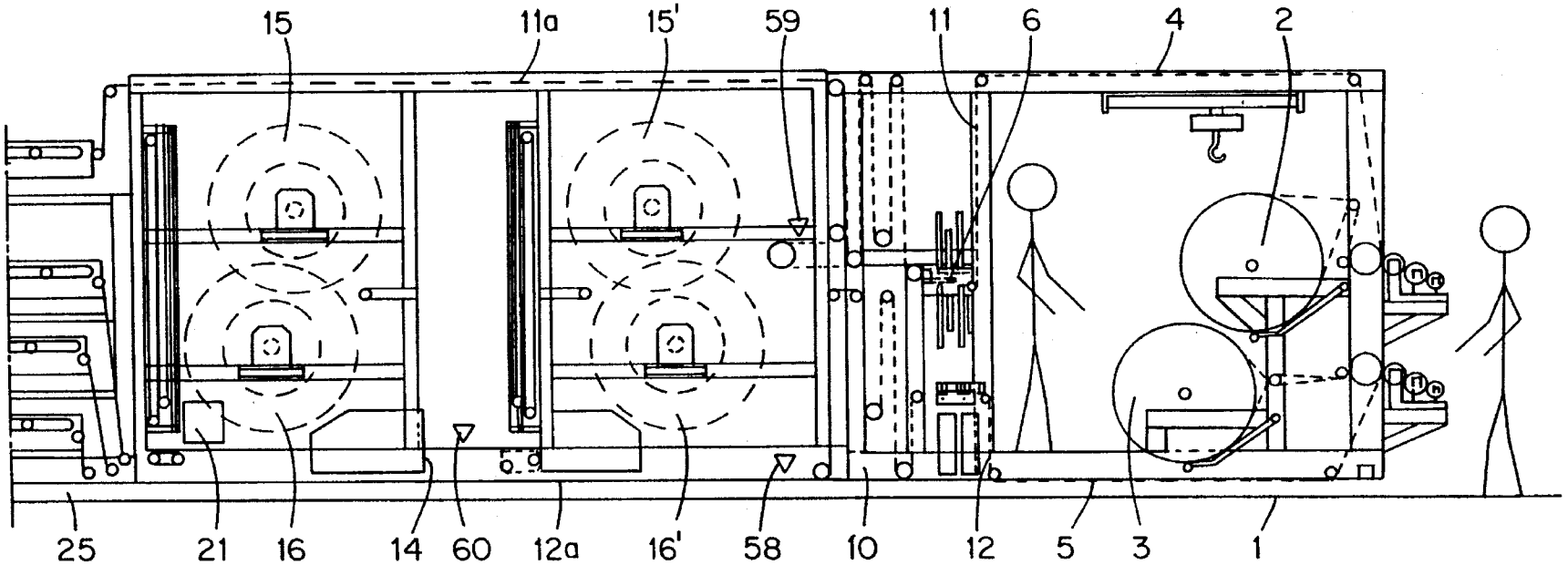
FIG. 1*a* and FIG. 1*b* respectively show end and side elevation views of entire apparatus for the production of the envelopes in accordance with the invention.
Figure 1B:
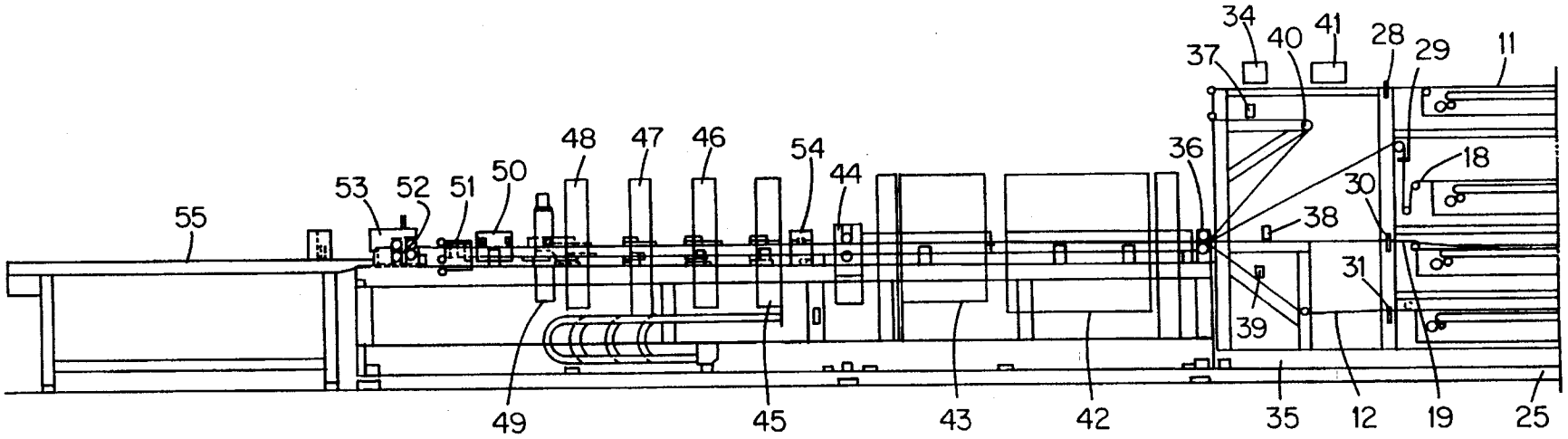

With reference to FIGS. 1*a* and 1*b* the method in accordance with the invention an apparatus will be described for the production of padded envelopes. FIGS. 1*a* and 1*b* represent a diagrammatic view of a preferred embodiment of the invention. This apparatus comprises a first station 1 with supply rolls 2 and 3 to be unwound to give an upper and a lower paper web, which together define the outer surfaces of the envelopes to be manufactured. As shown in FIG. 1*a* the paper web from the upper supply roll 2 runs upwards along a path indicated as 4 and the paper web from the lower supply roll runs downwards along a path indicated as 5 in FIG. 1*a* to the left. The station 1 furthermore preferably comprises a device 6 for the supply of a so-called self-seal closures for example in the form of an adhesive strip provided with a protective strip, such strip being in the illustrated apparatus applied to the lower paper web at predetermined distances apart and in the direction transverse to the direction of conveying (in FIG. 1*a* to the left) on the paper web. Following the station 1 there is in FIG. 1 to the left an adjoining station 10, which serves as a storage means for the paper web supplied from the upper and the lower paper supply rolls 2 and 3. In the station 10 the upper and the lower paper webs, which are referenced 11 and 12, are bent round in the vertical direction a plurality of times and in this manner "stored" before the paper web is then moved on along the path 11*a* and 12*a* to the left.

Following the station 10 there is a further station 14, which has at least two supply rolls 15 and 16 from which an upper and a lower web of padded material is drawn off, the upper web being referenced 18 and the lower one being referenced 19. In accordance with the illustrated embodiment of the invention in all two upper and two lower rolls 15, 15', 16 and 16' are provided in order in this manner to render possible a rapid replacement of the rolls or, respectively, a sequential employment of the rolls because there is a standby supply roll present in the station. The upper and the lower rolls 15 and 16 may comprise a pre-embossed or so-called globular paper. Preferably however plain paper is held on the rolls 15 and 16, as for instance kraft paper, which is embossed by an embossing device 21, arranged in the station 14 and diagrammatically illustrated for instance in the form of embossing rolls as the upper and lower paper webs, before it is drawn out of the station 14. Kraft paper has longer fibers, which lead to a high strength, something that is responsible, as regards embossing, for producing the preferably spherical cups for padding.

The supply of as yet non-embossed paper material on the rolls 15 and 16 leads to the advantage that, for instance, 5000 meters will be on a roll whereas only 200 meters of embossed globular paper could be held on a roll of the same diameter. The embossing device is only indicated symbolically in FIG. 1*a* and is referenced 21.

Following the station 14 there is a station 25, which serves to control the position of the lateral edges of the upper and lower paper webs 11 and 12 and of the upper and lower globular paper webs 18 and 19 and comprises a web tension regulation device. In order to ensure the correct position of the lateral edges of the individual webs use is made of sensors 28, 29, 30 and 31, which are connected electrically with lateral edge adjustment means (not illustrated in detail).

The station 25 is followed by a station 35, which serves to apply hot melt adhesive in a manner in accordance with the respectively planned production run. As shown in FIG. 1*b* in the station 35 the webs, of which there are four in the illustrated working embodiment (that is to say the upper paper web 11, the lower paper web 12, the upper globular paper web 18 and the lower globular paper web 19) are drawn together towards a first feed roll 36 and prior to being drawn together are provided in a fashion yet to be described with patches (i. e applications) of hot melt adhesive. In order to apply the hot melt adhesive use is made of nozzles 37, 38, and 39. A marking, preferably printed on the upper paper web, is detected by a sensor 34. The sensor 34 is preferably arranged in or at the station 35 and in the case of this embodiment of the invention detects markings printed on the upper paper web 11. The sensor 34 controls the operation of the nozzles 37, 38 and 39. The nozzle 37 is associated with the upper paper web 11 and applies hot melt adhesive to the inner side of the upper paper web 11 in the transverse direction, as shown in FIG. 1*b*, whereas the nozzle 38 applies hot melt adhesive in the transverse direction to the surface, facing the upper web 18 of globular paper, of the lower web of globular paper; the nozzle 39 is responsible for application of the hot melt adhesive to the inner surface, that is to say the surface facing the lower globular paper web 19, of the lower paper web 12. The application performed by the nozzle sections 37, 38 and 39 is timed differently, since the lead of the web 18 between the nozzle 37 and the first feed roll 36, of the lower roll 36 and the lower paper web 12 between the nozzle 39 and the first feed roll 36 is of different length. The application of patches of hot melt adhesive in the transverse direction has to be performed in accurate register so that the respective applications move past the nozzles 37, 38 and 39 in register, that is to say exactly aligned with one another, before such patches pass the first draw-in roll 36.

In the station 35, in the preferred embodiment of the invention, the hot melt adhesive is applied using the nozzle 37 from above onto the upper paper web 11, after which the upper paper web 11 is turned by a bend roll 40, its direction of conveying then being changed as well.

Following the station 35 a reactivating station 42 is provided, which is responsible for a reactivation of the hot melt adhesive applied in the longitudinal direction. There is then a cooling station 43, a second feed roll 44, and after this at least one further station 45 for the reactivation of the hot melt adhesive applied in the transverse direction. After this there preferably follows a second reactivation station 46 for the reactivation of the hot melt adhesive applied in the transverse direction. The above mentioned stations are followed then by a cooling station 47, preferably a second cooling station 48, a corner trimming device 49, and a punching device 50 for the holes or openings for a closure. There then follows a side edge guiding control unit 51 and a cutting device 52. In the case of a device of the type described designed for producing more than one row of envelopes from the roll of paper the cutting device 52 serves for longitudinal slitting, that is to say for severing apart envelopes produced alongside each other. There then follows a knife 53 for cutting in the transverse direction, that is to say for cutting apart consecutively following envelopes produced along a web part connecting them together.

For the control of the cutting device it is possible to provide a sensor 54, which in the illustrated working embodiment is arranged between the stations 44 and 45.

Behind the station 53 the envelopes produced are removed using a conveying device 54.

The manner of operation of the above-mentioned apparatus will now be explained in what follows.

The upper and lower webs 4 and 5 of paper (normally kraft paper) unwound from the rolls 2 and 3 are moved through the storage stations 10 past the station 16 and arrive at a station 25, which serves as a storage means and for control of the edges. Along the path of movement of the upper and lower paper webs 11 and 12 between the station 1 and the station 25 there are further nozzles 58, 59 and 60. The nozzle 58 and, respectively, the nozzle 59 serve for the application of a hot melt adhesive in the longitudinal direction on the upper and, respectively, lower paper web 12 and, respectively, 11.

Figure 2:
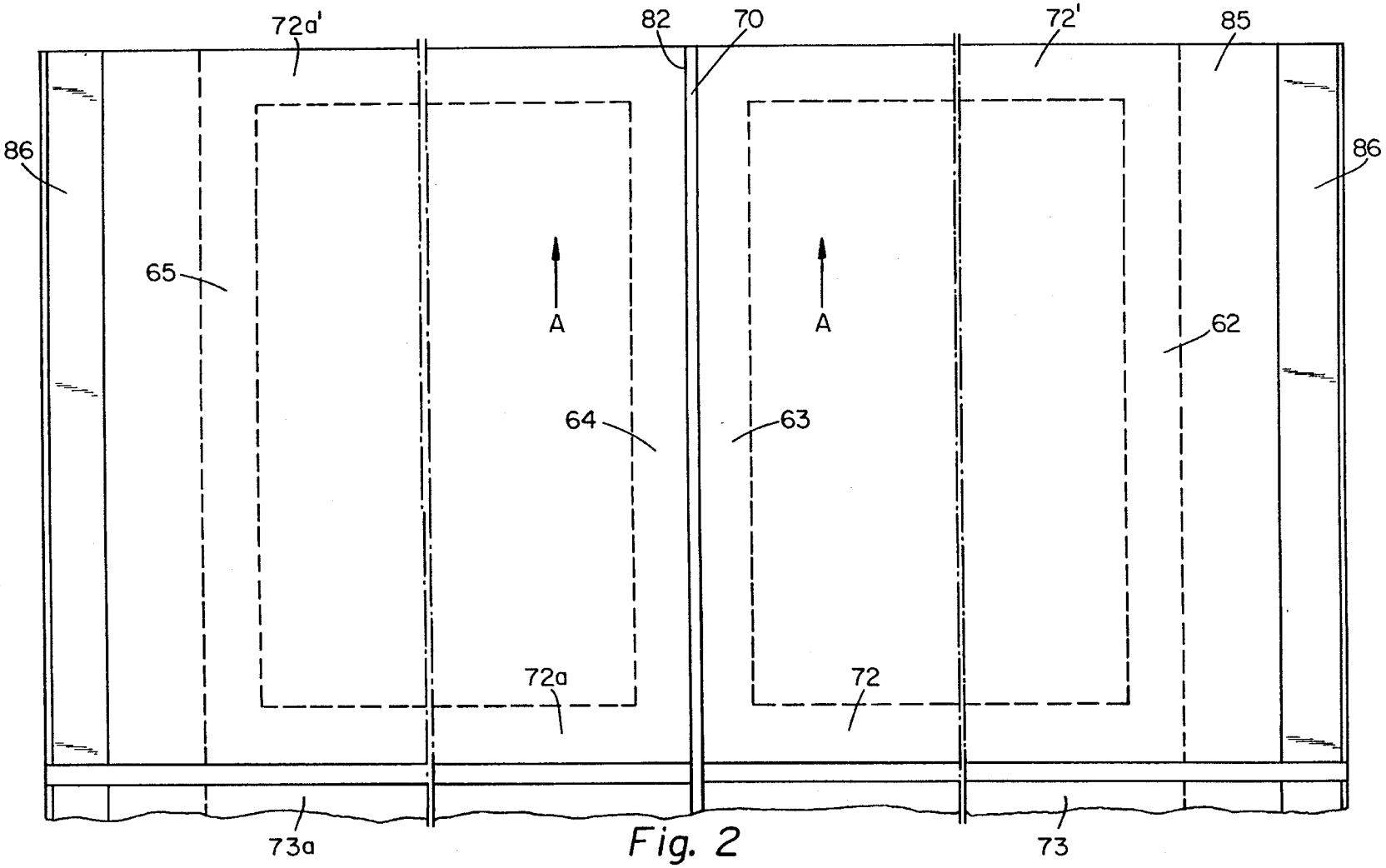
FIG. 2 is a representation of a part of a paper web from which envelopes are produced two by two in order to explain the application of the hot melt adhesive in the longitudinal and transverse directions on the upper and lower paper webs.

By means of the nozzles 58 and 59 the application of the hot melt adhesive is performed along the webs 62, 63 and furthermore 64 and 65 illustrated in FIG. 2. The nozzles 60 provided in the station 14 are responsible for application of the hot melt adhesive centrally and in the longitudinal direction on the cup embossed or globular paper following the webs 66 and 68 in FIG. 3. Nozzles 58, 59 and 60 are preferably connected with a control unit which controls operation of such nozzles in a manner dependent on the paper web speed as well.

Figure 3:
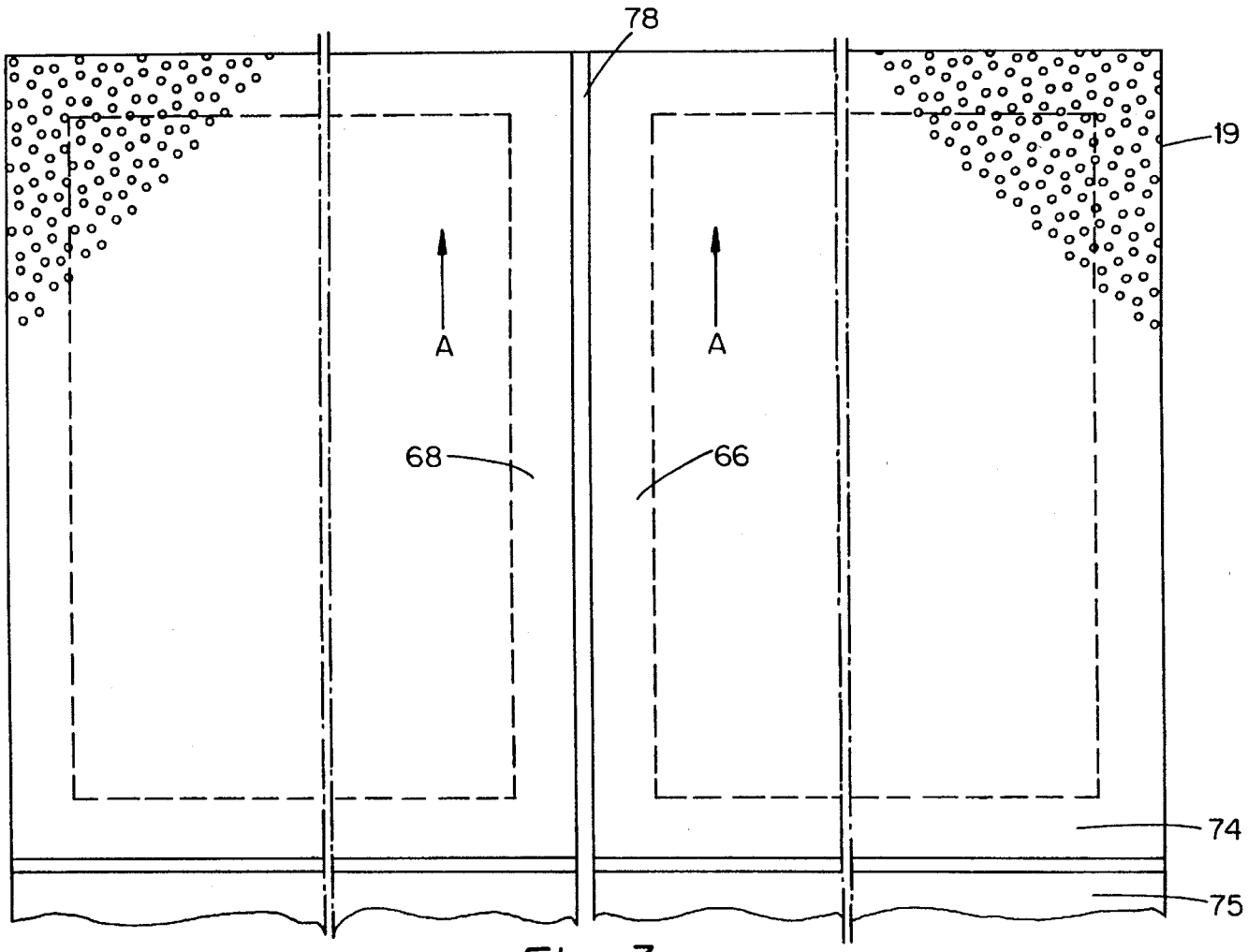
FIG. 3 shows a view corresponding to FIG. 2 in order to explain the application of the hot melt adhesive on the upper and the lower paper layer in the longitudinal and the transverse directions.
Figure 4:
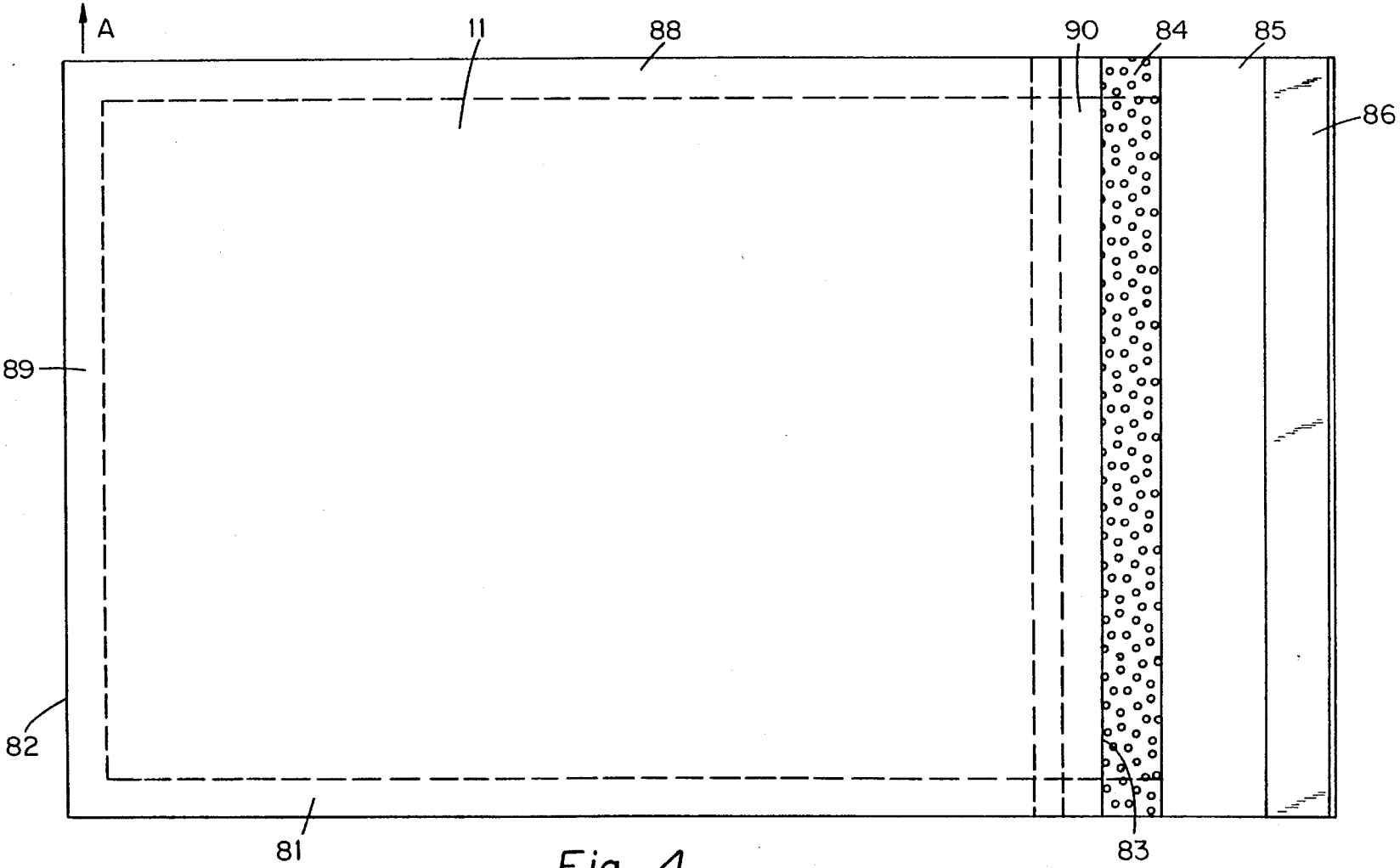
FIG. 4 is a plan view of an envelope.

FIG. 2 shows as an example the lower plain paper web 12 with the transverse and longitudinal application of the hot melt adhesive. FIG. 3 shows as an example the longitudinal and transverse application of the hot melt adhesive onto the globular paper. The longitudinal application is performed along the parts 66 and 68 by means of the nozzle sections 66. In FIGS. 1 through 4 the movement or conveying direction of the processed paper or, respectively, of the processed paper webs is indicated by arrow A. In accordance with the above description as in FIG. 3 an application of hot melt adhesive is made centrally on the finished globular paper, that is to say on the part of the globular paper which is later to be slit. The application using the nozzles 60 as related to the longitudinal parts 66 and 68 is preferably so performed that a central gap of preferably 2 mm is left free which serves to ensure, that in the case of a design of the apparatus to produce more than one row of envelopes from a roll, the parts to which hot melt adhesive has been applied do not have to be moved through the cutting device 52 so that there is substantially no fouling of the cutting device 52 by hot melt adhesive, The representation in accordance with FIG. 2 shows the lower paper web for two envelopes arranged with bilateral symmetry about the line 70 in accordance with FIG. 4, the applied patches of hot melt adhesive 62 and 65 corresponding to the connection part in FIG. 4 and the flaps 85 of the envelopes to be produced in FIG. 2 being oppositely arranged in relation to each other. This means that two envelopes in accordance with FIG. 4, which are connected together at the edge 82 in accordance with FIG. 4, are produced in the case of a design of the apparatus for twin-layer or multiple row production. A transverse patch referenced 72 in FIG. 4 corresponds to the part 81 in FIG. 4 and constitutes a fraction of the part of the envelope extending above the transverse patch 72, whereas the following transverse patch referenced 73 constitutes the marginal adhesive layer of the next envelope, In the station 35 means are provided for the application of hot melt adhesive onto the upper paper web by means of the nozzles 37 in the direction which is transverse in relation to the direction of conveying, whereas the nozzles 39 apply hot melt adhesive in the transverse direction onto the lower paper web 12. After the application of hot melt adhesive, in the station 35 there is a change in direction of the paper webs in order to bring them together with the correct association of the surfaces as shown in FIG. 1. In order to perform the application of hot melt adhesive from above onto the upper paper web 11, there is, as shown in FIG. 1, a change in direction at the bend roll 40 as has been described above.

The patches of hot melt adhesive already present in the longitudinal direction are reactivated in the station 42, that is to say for the purpose of bonding together the sandwiched paper webs they are reheated so that a connection is produced between the opposite webs. After such bonding or heating there is a cooling of the webs in the station 43. Following this there is a reactivation of the hot melt adhesive sections applied in the transverse direction by at least one station 45 or by two stations 45 and 46 in accordance with FIG. 1. The provision of two such heating or, respectively, reactivating stations offers the advantage that heating does not have to be performed in a single step to extremely high temperatures, but rather in two sequentially performed stages through different temperature ranges. Thus in the first reactivating station heating is performed to, for instance, 100° C. whereas in the second reactivating stage heating to between 120° C. and 160° C. takes place. This involves the beneficial effect that the speed of feed can be increased.

Using the two sequentially arranged reactivating stages 45 and 46 a reactivation of the hot melt adhesive applied in the transverse direction is achieved while at the same time avoiding the disadvantage of causing the hot melt adhesive to penetrate the paper and producing black stains. If there were to be an excessive heating of the hot melt adhesive the paraffin wax comprised in the hot melt adhesive would soak through the paper and give rise to black areas.

After the two-stage reactivation of the hot melt adhesive in the transversely extending zones cooling of the same is performed in the station 47. The second cooling station 48 can be optionally provided in addition in order to perform a second cooling of the transverse zones. In the illustrated working embodiment of the invention two activating stations are provided for the hot melt adhesive zone extending in the transverse direction and two sequentially arranged cooling stations are provided for such zones.

In accordance with the illustrated embodiment of the invention a corner trimming device 49 is provided to cut the envelope flaps to an oblique configuration, following which there is the punching device 50, which produces the holes through the envelope and the flap thereof in order to receive fastening means such as bifurcated rivets.

Given a multiple row design of the apparatus there is lastly a knife extending in the longitudinal direction as a cutting device 52, which cuts the two envelopes apart which are produced one after the other in the direction of conveying, and which are bilaterally symmetrical about the line referenced 70 in FIG. 2, such line extending along the previously described gap, with a width of about 2 mm, between the webs 63 and 64.

In a preferred embodiment of the invention a gap of about 2 mm in width is also left adjacent to the hot melt adhesive sections 72 and 73 extending in the transverse direction in the upper and lower paper webs and/or in the parts 74 and 75 on the globular paper, such gap facilitating the cutting in the transverse direction by means of the knife 53 and preventing fouling of the knife 53. This gap between the parts 72 and 73 and furthermore between the parts 74 and 75 serves simultaneously as a severing line between the envelopes emerging one after the other from the apparatus.

Between the second feed roll 44 and the station 45 there is a sensor 54, preferably in the form of a photoelectric cell, which controls operation of the transverse knife 53 and by responding to the printed markings ensures a true, in-register operation of the knife in the gap between the parts 72, 73 and, respectively, 74 and 75. It will be clear that the sensor 54 may be provided at some other point on the apparatus as well.

The nozzles 37, 38 and 39 preferably take the form of multiple nozzles. The nozzle unit 60 preferably comprises a single nozzle with a mask, which defines the application zone on the globular paper while keeping a linear part free, for example, of the middle of the hot melt adhesive applied in order to ensure a gap of for instance 2 mm in the longitudinal direction, which is indicated in FIG. 3 by the line 78.

As will appear from the above account, as regards the globular paper webs 18 and 19 there is an application of hot melt adhesive in the longitudinal and transverse directions only on one of the webs, preferably on the lower globular paper web 19, in accordance with FIG. 3. The reactivation station 42 heats up the applied hot melt adhesive and the respectively opposite globular paper web is bonded to the globular paper web having had the hot melt adhesive applied on it. Accordingly it is sufficient in the embodiment of the invention described for there to be one application of hot melt adhesive between the upper plain paper web and the underlying globular paper web on one of the webs along the bonds. The same applies for the two webs of globular paper 18 and 19 to be superposed. For the production of the envelope in accordance with the invention hot melt adhesive is applied to parts of the respective webs in the longitudinal and the transverse direction and such hot melt adhesive areas are only activated later by an associated reactivation station in order to produce the bond as such. In this case it is essential for the application of the hot melt adhesive to be performed both in the longitudinal direction and also in the transverse direction in-register on the three webs.

In accordance with the view of FIGS. 2 and 3 the lower plain paper web is provided with hot melt adhesive in the middle along the connection areas 63 and 64 and laterally along the areas 62 and 65 and furthermore in the transverse direction along the zones 72 and 73. Accordingly the hot melt application of adhesive is formed on the downwardly facing surface of the upper web 11. As regards the two globular paper webs such an application of hot melt adhesive is merely made on one web, preferably the lower globular paper web 18, in the longitudinal direction along the zones 66 and 68 and in the transverse direction along the zones 64 and 75.

Owing to the patches (or connection zones) of hot melt adhesive depicted in FIGS. 2 and 3 prior to severing by the cutting device two envelopes arranged with bilaterally symmetry in relation to each other are obtained. The adhesive zones 72 and 72' (see FIG. 2) constitute the lateral connection sections whereas the zone 63 constitutes the lower connection edge. The same applies for the oppositely arranged envelope with the connection or bonding parts 72*a*, 72*a* and 64. Where the hot melt adhesive is applied at 62 and, respectively, 65 a bond is produced for attachment with the padding paper web next to this lower paper web, and moreover however owing to the lack of a corresponding provision of patches of hot melt adhesive on the globular paper (see FIG. 3) the opening of the envelope is left open.

The width of the patches of hot melt adhesive is preferably made equal to 10 mm for the zones 72, 72', 63 and 64, whereas the width of application of the hot melt adhesive in the longitudinal direction corresponding to the zones 62 and 65 is made equal to 5 mm. The patch width of the hot melt adhesive in the section 66, 68 and 74, 75 is preferably equal to 10 mm.

As shown in FIGS. 2 and 3 the line 70 constitutes an axis of symmetry for the respective lower paper web or, respectively, lower padded web to be produced. FIGS. 2 and 3 respectively show a plan view of those surfaces of the lower paper web or, respectively, lower padded paper web, on which the hot melt adhesive is to be applied. In the case of this production in pairs of envelopes in rows from the roll the width indicated in FIGS. 2 and 3 (transversely in relation to the direction of the arrow A) of the respectively lower webs exceeds the width of the associated upper web, that is to say the lower paper web 12 has a greater width than the upper paper web 11 and the upper globular paper web has a larger width than the upper globular paper web 18. This may be seen to follow from the description now to be given of a product manufactured using the method with reference to FIG. 4. Accordingly the patches of applied hot melt adhesive at 62 and 19 to the outside, that is to say remote from each other with reference to the line 20, as related to the lower paper web and the lower globular paper web may be further removed from the line 20 than the corresponding patches of hot melt adhesive between the upper paper web and the upper globular paper web.

It is an advantage to employ paper webs for the padded material in such a fashion that the paper web is processed by an embossing device or the like so that there is a certain padding effect and that the processing of the paper takes place within the apparatus illustrated. The embossing and/or use of globular paper as a padding layer is therefore described as a preferred alternative. A further advantageous feature is, as it has turned out, performing the reactivation of the hot melt adhesive zones, more particularly in the transverse direction, in two steps in order on the one hand to prevent damage to the paper and on the other hand to render possible the production of envelopes at a high speed.

To the extent that control of the lateral edges of the paper web or storage thereof is to be performed, attention is called to the said German patent publication DE 36 12 136 A1.

FIG. 4 shows a rear view of an envelope manufactured in accordance with the invention. The one web of plain paper extends along the entire length of the envelope, whereas the second paper web constitutes the zone referenced 81 and extends from the lower edge 82 of the envelope as far as one edge of the opening. It is convenient if one of the two webs of globular paper extends past the edge 38 towards the flap of the envelope, as is indicated by the reference 84 so that the flap 85 of the envelope is covered with globular paper along the strips referenced 84. Reference 68 indicates an adhesive strip, which is covered over by a protective film or protective layer. The fold line of the envelope for the flap 85 corresponds to the line 83. After folding over the flap 85 the strip of globular paper will partly cover the rear side of the web 81 over a correspondingly wide strip. The peripheral, essentially U-like zone, defined by the application of hot melt adhesive, of the envelope produced is referenced 88 and marked in chained lines.

The upper web 11 of plain paper, underneath which the upper globular paper web 18 is located, is followed by the lower web 19 of globular paper, of which the projecting section 84 is visible. There then follows in this order the lower paper web 12, of which the section 85 is to be seen. The paper web 11 is bonded to the globular paper web 12 following the same along the zone referenced 81, 88, 89 and 90, this constituting a preferred embodiment of the invention, that is to say the hot melt adhesive area 90 extends as far as the edge referenced 83 of the upper paper web 11. Between the upper and the lower globular paper web 18 and 19 the envelope opening remains along the edge zone 83. Between the lower globular paper web 19 and the lower web 12 of plain paper there is a hot melt adhesive bond area along the edge system referenced 81, 89 and 88 and at least along the zone referenced 84.

The oblique cutting of the flap 85 of the envelope flap 85 and furthermore the punching of any holes or the like in the envelope are not illustrated in FIG. 4.

In the above a description has been provided of the method and an apparatus for the production of mailing containers, more particularly envelopes, as one embodiment with reference to the production of more than one row of envelopes from a roll. It will be clear that the apparatus may be designed for the production of only one row so that the web of plain paper and globular paper in accordance with FIGS. 2 and 3 would only have half the width indicated.

Although the present invention has been described and illustrated in detail, it should be clearly understood that the same is by way of illustration and example only and is not to be taken by way of limitation, the spirit and scope of the present invention being limited only by the terms of the appended claims.

We claim:

1. A method of manufacturing a padded mailing container, comprising the steps of:

applying a hot melt adhesive along first predetermined zones between an elongate upper web and an elongate upper padding web;

applying said hot melt adhesive along second predetermined zones between an elongate lower web and an elongate lower padding web;

applying said hot melt adhesive along third predetermined zones to one of the upper and lower padding webs; and activating the hot melt adhesive to effect permanent bonding thereby between the upper web and the upper padding web, between the lower paper web and the lower padding web, and between the upper and lower padding webs, with a portion of one of the upper and lower webs being left free of the hot melt adhesive and available to provide closure means for closing the mailing container.

2. The method according to claim 1, wherein:

the hot melt adhesive is dried after it is applied.

3. The method according to claim 1, wherein:

the elongate upper and lower padding webs are each unrolled from a respective roll and are embossed by respective embossing means before being disposed between the upper and lower webs.

4. The method according to claim 1, wherein:

one of the upper and lower webs is provided with a printed marking which is employed at least for the control of the application of the hot melt adhesive on the webs.

5. The method according to claim 1, wherein:

the hot melt adhesive is applied to the respective webs at predetermined zones thereof, said zones being oriented longitudinally and transversely relative to a direction of motion of the webs.

6. The method according to claim 5, wherein:

at least the hot melt adhesive applied in the transverse direction is reactivated in two successive intervals.

7. The method according to claim 6, wherein:

the reactivation of the hot melt adhesive comprises the steps of first heating the same to about 100° C. for a first time interval and then heating it further to a temperature in the range 120° C.–160° C. for a second time interval.

8. The method according to claim 7, wherein:

the hot melt adhesive is applied in the longitudinal central zone in two neighboring zones separated by a gap free of the hot melt adhesive.

9. The method according to claim 1, wherein:

the upper and lower webs are respectively provided with a marginal patch of hot melt adhesive extending in a longitudinal direction and with a patch of hot melt adhesive extending in a transverse direction.

10. The method according to claim 1, wherein:

said mailing containers are produced in multiple rows from the respective elongate webs and the hot melt adhesive is applied in a zone extending in a longitudinal direction centrally of the webs as well in zones at the edges of the webs.

11. The method according to claim 10, wherein:

the hot melt adhesive is applied in a longitudinal central zone in two neighboring zones separated by a gap free of the hot melt adhesive.

12. The method according to claim 11, wherein: the gap is about 2 mm wide.

13. The method according to claim 11, wherein:

the hot melt adhesive is applied in a transverse zone in two neighboring zones separated by a gap free of the hot melt adhesive.

14. The method according to claim 13, wherein:

the reactivation of the hot melt adhesive comprises the steps of first heating the same to about 100° C. for a first time interval and then heating it further to a temperature in the range 120° C.–160° C. for a second time interval.

15. The method according to claim 13, wherein:

a width of the hot melt adhesive as applied in the longitudinal direction is about 5 mm.

16. The method according to claim 15, wherein:

the reactivation of the hot melt adhesive comprises the steps of first heating the same to about 100° C. for a first time interval and then heating it further to a temperature in the range 120° C.–160° C. for a second time interval.

17. The method according to claim 11, wherein:

a total width of the two neighboring zones and the gap is about 10 mm.

18. The method according to claim 10, wherein:

the hot melt adhesive is applied in a transverse zone in two neighboring zones separated by a gap free of the hot melt adhesive.

19. The method according to claim 18, wherein:

the reactivation of the hot melt adhesive comprises the steps of first heating the same to about 100° C. for a first time interval and then heating it further to a temperature in the range 120° C.–160° C. for a second time interval.

20. The method according to claim 19, wherein:

a width of the hot melt adhesive as applied in the longitudinal direction is about 5 mm.

21. The method according to claim 1, wherein:

the hot melt adhesive is applied in two neighboring zones separated by a gap free of the hot melt adhesive.

22. An apparatus for manufacturing padded mailing containers, comprising:

means for unwinding lengths of upper and lower paper webs from respective rolls thereof;

means for unwinding upper and lower webs of padded material from respective rolls thereof;

means for connecting the upper and lower paper webs with the padded webs adjacent to intended edges of the respective mailing containers;

means for feeding the connected paper webs;

a device for cutting apart the mailing containers to a predetermined format from the connected webs;

a first station for providing the upper and lower padded webs, which includes at least a first supply roll to be unwound to supply the upper padded web and a second supply roll to be unwound to supply the lower padded web;

a second station for the application of hot melt adhesive on the upper and lower paper webs and on at least one of the two padded webs, and including a plurality of nozzles arranged in a transverse direction relative to a longitudinal direction of said paper webs;

means for controlling a timed operation of the nozzles for applying the hot melt adhesive therefrom; and a first station for reactivating the hot melt adhesive applied in the transverse direction to a first temperature range; and a second station for reactivating the hot melt adhesive applied in the transverse direction to a second higher temperature range.

23. The apparatus according to claim 22, further comprising:

a third station for the reactivation of the hot melt adhesive applied in the longitudinal direction.

24. The apparatus according to claim 23, wherein:

the third station comprises means for controlling said two-step reactivation, such that the hot melt adhesive is reactivated in a first step by being heated to a temperature of about 100° C. for a first time interval and then in a second step to a temperature in the range 120° C. to 160° C. in a second time interval.

25. The apparatus according to claim 24, wherein:

said second station comprises means for applying said hot melt adhesive in the transverse direction in two neighboring zones with a gap of predetermined therebetween which is free of the hot melt adhesive.

26. The apparatus according to claim 22, further comprising:

a fourth station for cooling the hot melt adhesive applied in the longitudinal direction.

27. The apparatus according to claim 22, further comprising:

at least one station for cooling the hot melt adhesive applied in the transverse direction.

28. The apparatus according to claim 22, further comprising:

a station for storage of at least one of plain paper web lengths and padded web lengths.

29. The apparatus according to claim 22, wherein:

the storage station includes a control device for registering lateral edges of at least one of the upper and lower plain paper webs and the upper and lower padded webs.

30. The apparatus according to claim 22, further comprising:

a nozzle device for the application of hot melt adhesive in the longitudinal direction.

31. The apparatus according to claim 22, wherein:

said second station comprises means for applying said hot melt adhesive in the transverse direction in two neighboring zones with a gap of predetermined therebetween which is free of the hot melt adhesive.

32. The apparatus according to claim 31, wherein:

the gap is about 2 mm wide.

33. The apparatus according to claim 32, wherein:

a total width of the two neighboring zones and the gap therebetween is about 10 mm.

* * * * *